United States Patent [19]

Hotchkiss

[11] 4,229,616

[45] Oct. 21, 1980

[54] CABLE CONNECTOR COVER

[76] Inventor: Kenneth W. Hotchkiss, Rte. 1, Blue Mountain, Golden, Colo. 80401

[21] Appl. No.: 932,469

[22] Filed: Aug. 10, 1978

[51] Int. Cl.[3] ..... H01R 13/52

[52] U.S. Cl. ..... 174/138 F; 174/65 R; 174/92; 339/116 C

[58] Field of Search ..... 174/65 R, 65 G, 92, 174/93, 138 F; 339/36, 75 M, 75 P, 107, 116 R, 116 C, 198 J, 208

[56] References Cited

U.S. PATENT DOCUMENTS

| | | | |
|---|---|---|---|
| 2,894,056 | 7/1959 | Bogese | 174/92 |
| 2,908,744 | 10/1959 | Bollmeier | 174/92 X |
| 2,962,542 | 11/1960 | Witt | 174/92 X |
| 2,996,567 | 8/1961 | Channell et al. | 174/92 |
| 3,127,471 | 3/1964 | Greiner | 339/107 X |
| 3,187,090 | 6/1965 | Edwards | 174/138 F |
| 3,278,674 | 10/1966 | Matthysse et al. | 174/138 F |
| 3,499,102 | 3/1970 | Gillemot et al. | 339/36 X |
| 3,751,579 | 8/1973 | Nojiri | 174/65 G X |
| 4,130,330 | 12/1978 | Chandler | 339/75 M |

FOREIGN PATENT DOCUMENTS

| | | | |
|---|---|---|---|
| 564946 | 3/1958 | Belgium | 174/65 R |
| 2406003 | 8/1974 | Fed. Rep. of Germany | 174/93 |

*Primary Examiner*—Laramie E. Askin
*Attorney, Agent, or Firm*—Kyle W. Rost

[57] ABSTRACT

A cable connector cover has a U-shaped housing surrounding a cable passage with the arc at the base of the U-shape adjacent an arcuate portion of the passage. The cover has a double wall and an intermediate space surrounding the passage, and a sliding door is moveable in the space to partially cover the passage. Friction means allow the door to be retained in any of various positions covering portions of the passage. A normally extending member attached to the door closes the open side of the U-shaped housing and is slidable with the door toward the arcuate side of the housing to clamp the cable against the housing. Lips on the lateral sides of the normally extending member are severable from the remainder of the member to allow close clamping of extremely small cable.

8 Claims, 8 Drawing Figures

CABLE CONNECTOR COVER

BACKGROUND OF THE INVENTION

1. Field of the Invention

The invention relates generally to electricity, conductors and insulators. More specifically, the invention relates to sheaths, coverings, or housings for cable connections, especially to water resistant coverings for telephone cable connectors.

2. Description of the Prior Art

It is often desirable to shield electrical connections against foreign matter, especially moisture, to protect the connection against contamination and failure. Numerous covers have been proposed for this purpose, some of which are intended to be perfectly air tight while others are merely modestly efficient in preventing gross contact with the connection. Such covers may be constructed in snap-together halves with tongue and groove edges that permanently engage. Other construction is known to include a sleeve that overlaps the connection and is tightly bound to the cable at either end thereof by clamps, grommets, or tape. Those covers that merely prevent gross contact with the connection may also include snap-together halves, but the connection to the cable may be quite loose.

The primary problem in creating any sort of cable connection cover is adapting the cover to snugly engage the cable itself, since cables are made in many different sizes. It is quite difficult and impractical to design a cable cover for each size of cable that may be found in a specific type of application, and for this reason most preexisting covers are not well suited for use on a variety of cable sizes. Some attempted solutions to the cable size problems have employed stretchable rubber sleeves that are applied with a special tool to bring the sleeve over the connection, after which the sleeve grips the cable through its own resilience. Another solution is to use a plastic bag-like cover that is enveloped over the connection and then taped similarly or otherwise sealed to the cable. Such covers are unsatisfactory because they are awkward to use, disorderly in appearance, and difficult to apply, remove, or replace.

The present invention offers a solution to all of these problems by creating a cable connector cover that is easy to apply or remove, adaptable to a wide range of cable sizes, and suited for use in circumstances where a modest amount of dirt or water may be encountered.

SUMMARY OF THE INVENTION

A cable connector cover has a snap-together body that largely encloses the connector and partially surrounds the ingoing and outgoing cables with a housing. A sliding door is carried by the body adjacent to the cable housing opening and is slidable into the opening to clamp and deform the cable against the housing. Frictional retaining means holds the door in clamping position against the cable. The door carries a cable contacting member that has severable side lips allowing the shape of the contacting member to be mechanically altered for closer engagement of extremely narrow cables in the housing.

The main object of the invention is to create a cover for cable connectors that may be subject to occasional dirt or moisture. The invention is particularly applicable to telephone cable connectors of the type commonly used on multi-line telephones. Often these connectors are in exposed locations on a floor and suffer exposure to cleaning liquids and dirt.

An important object is to create a connector cover that is easily applied or removed from the cable connector without the need for special tools. The invention relates to a snap-together cover that is durable and snugly fits the connector and its cables without requiring permanent attachment or being difficult to remove for necessary access to the connector.

A further important object is to create a connector cover that snugly engages a variety of cable sizes without requiring extensive alteration of the cover structure. A sliding door cooperates with a cable housing opening in the cover to clamp the cable and deform the cable to a limited degree against the door and the housing. Minor modification of the sliding door allows extremely small cable to be appropriately clamped.

DESCRIPTION OF THE PREFERRED EMBODIMENT

Figure 1:
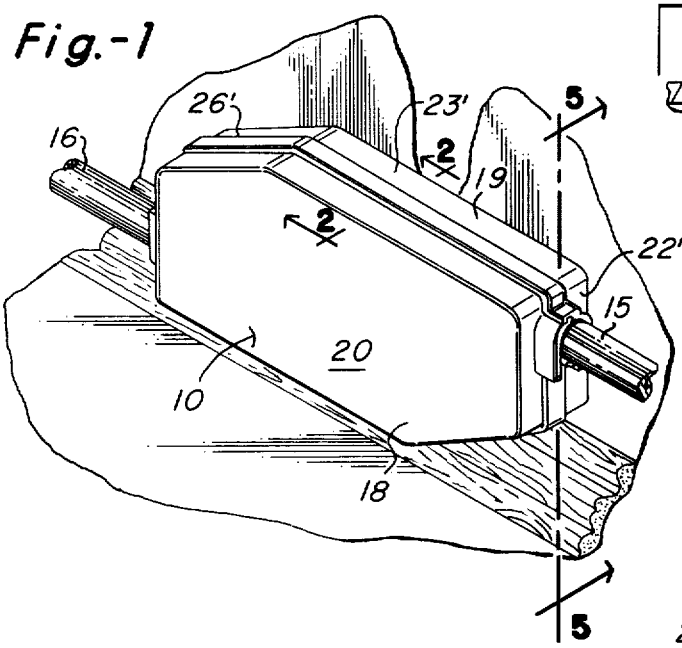
FIG. 1 is an isometric view of the cable connector cover mounted on a wall with a contained cable connector and cable.
Figure 3:
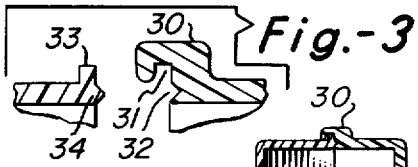
FIG. 3 is an enlarged view of the mating means of FIG. 2 shown separated for clarity.

The connector cover 10 is shown in an embodiment especially suited to protect telephone connectors 12 of the type commonly employed on multi-line telephones. This type of connector consists of two mating halves 13, 14, each of which has a cable 15 or 16, respectively, leading into the appropriate half. The halves are then joined by a male-female socket engagement with cables 15 and 16 departing in opposite directions. Often the connector will be held together by screws or other fastening means, but separation of the halves is quite simple and they can be rejoined easily. This type of connector is well known and widely used throughout multi-line telephone installations, as it allows the various lines to be pre-wired to their respective cable connector halves, after which installation of the telephones is accomplished by plugging the halves together.

Quite often the connector lies unprotected on the floor near the telephone and is occasionally exposed to a modest quantity of water through floor washing and the like. Unprotected connectors are therefore subject to malfunction by entry of this water into the connector halves, disrupting the proper electrical connections that are intended to be maintained in the connector. The connector cover 10 is intended to remedy this problem primarily by providing a water resistant housing around the connector, and secondarily by creating a convenient means for mounting the connector off the floor.

Figure 7:
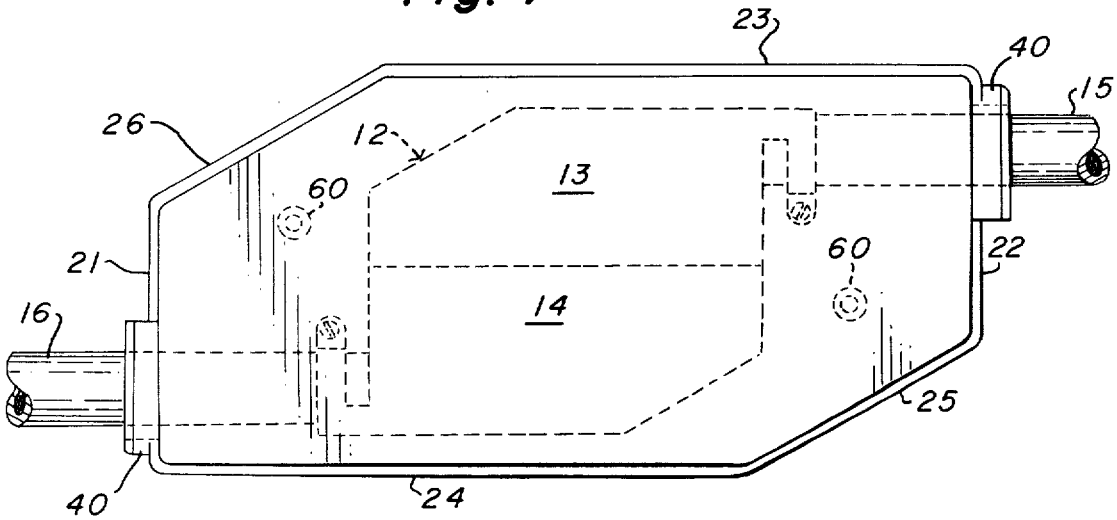
FIG. 7 is a side elevational view of the cover with the contained cable and connector and some internal structure of the cover shown in phantom.

In FIGS. 1 and 7 the cover is shown in a configuration compatible to the common connector 12. The cover itself is formed from first body portion 18 and second body portion 19, which are configured substantially in mirror images of each other and are adapted to mate closely along opposed edges. The body portion 18 has face 20 sharing the approximate outline of the connector 12, wherein the perimeter is defined by normally extending side end walls 21 and 22 that are mutually parallel; top and bottom side walls 23 and 24 that are mutually parallel and normal to both side walls 21 and 22 and face 20; and side walls 25 and 26 that are normal to face 20 and diagonal to both walls 21, 22 and 23, 24, for example forming an interior angle of 120 degrees with walls 21, 22. Walls 21 and 24 form a corner, as do edges 22 and 23. Second body portion 19 has similarly configured face and side walls in mirror image designated by corresponding numbers 20'-26'.

Figure 2:
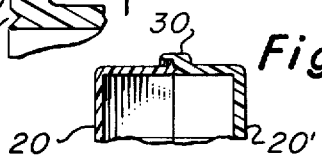
FIG. 2 is a cross-sectional view of the cover taken along the plane of line 2—2 of FIG. 1, showing the mating means between opposed cover portions.

The respective walls 21-26 and 21'-26' are connected at their edges most distant from face 20 or 20' by tongue and groove snap-together union best shown in FIG. 2. The illustrated union is quite snug and resists separation through pressure or tension either in the plane of face 20 or the plane of side walls 21-26. Under ordinary circumstances, the union will not permit easy passage of water or dust, although it would not necessarily be water tight if submerged for a prolonged period.

The snap-together union is operative in two planes to create a tight seal against entry of foreign matter. Body portion 19 may have two grooves, with a raised perimetric rib 30 providing necessary thickness in the side wall to contain the grooves. Groove 31 extends normally outwardly from the side wall, approximately parallel to the plane of face 20', and may have a rectangular cross-section. Groove 32 extends in the plane of the side wall toward face 20' and may be V-shaped in cross-section. Body portion 18 has tongues corresponding in shape and position to be engaged in the grooves 31 and 32. Tongue 33 is rectangular in cross-section and extends normally outwardly from the side wall, while tongue 34 is V-shaped in cross-section and extends in the plane of the side wall away from face 20. The cover 10 is preferably constructed from a plastic material with sufficient resilience and flexibility that the halves 18 and 19 are snapped together with hand pressure. Other configurations for the snap-together union may be employed, or other means for holding the halves together may be substituted for the above described structure.

Figure 4:
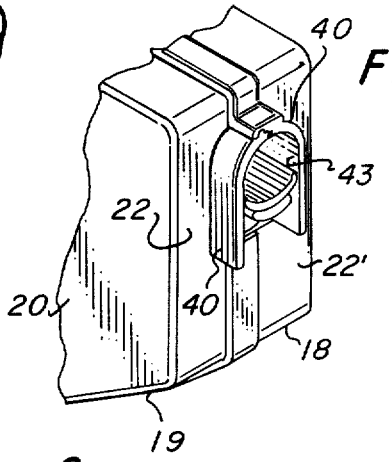
FIG. 4 is a fragmentary view of one end of the cover, showing the structure of the cable opening and housing.
Figure 5:
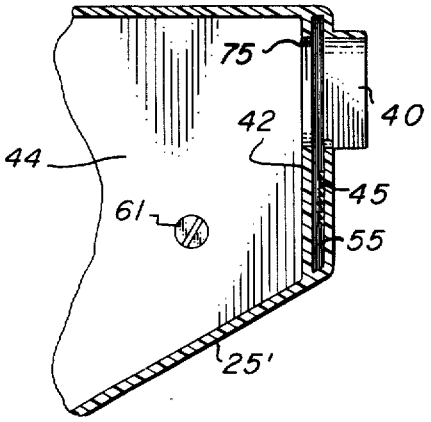
FIG. 5 is a cross-sectional view of one body portion of the cover viewed from inside the cover in the direction of line 5—5 in FIG. 1.

With reference now to FIGS. 4 and 5, it will be noted that the side walls 21, 21' and 22, 22' are partially interrupted by cable housings 40 extending outwardly therefrom. Each housing portion extends approximately normally to the adjacent side wall portion, and, when the body portions 18 and 19 are united, the housing has a U shape with a distance between the sides of the U approximating the maximum cable width that the cover is suited to accommodate. Within body portions 18 and 19, a double wall is formed at each end wall, as best shown in FIG. 5. The inner wall 42 is spaced from the end wall and parallel thereto. The cable opening 43 defined in part by housing 40 extends uniformly through inner wall 42 into the central cavity 44 of the connector cover. The inward facing side of the end wall may have a plurality of angled teeth 45, each tooth having an upwardly sloping bottom surface.

Figure 6:
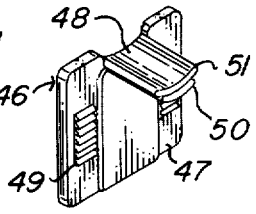
FIG. 6 is an isometric view of the sliding door.

A sliding door 46, best shown in FIG. 6, consists of a planar panel 47 with an arcuate cable contacting member 48 normal thereto at the upper edge of the panel as viewed in FIG. 5. One face of panel 47, for example the outer face, has a plurality of bosses or angled teeth 49 arranged in a vertical row. The teeth preferably are angled with a downwardly sloping top surface. A similar row of teeth may be located on the opposite edge of the outer face, also, as illustrated in FIG. 6. Cable contacting member 48 will be seen to have a thickened central area 50 with a relatively thinner lateral lip 51 at either side thereof. Door 46 is engaged in gap 55 between the inner and outer end walls of each body portion and, when the two body portions are snapped together, the cable contacting member 48 will be contained between the sides of the U-shaped housing, and the arcuate shape of element 48 will cooperate with the U shape to close the open end thereof, making cable opening 43 essentially oval. Door 46 is slidable in gap 55, moving element 48 along the axis of symmetry of the U-shaped housing to alter the length of the oval cooperatively formed between the housing and door.

In use, the cable connector 12 may be assembled in the usual way, or if previously connected, the mating halves need not be disturbed. Body portions 18 and 19 are initially separated and a door 46 is inserted in gap 55 between walls 42 and 21 or 21' and walls 42 and 22 or 22' in either portion 18 or portion 19. The body portions are then placed on opposite sides of the connector and snapped together by hand pressure. At this point, the cover halves are firmly united but the cables 15 and 16 may be quite loosely engaged in housings 40. Doors 46 are slidably contained in gaps 55 and the angled teeth 49 are engaging the angled teeth 45. At this point, either finger pressure or a pinching tool such as a plier may be used to slide member 48 toward the arc of the U-shaped housing, thereby reducing the length of the oval opening and snugly engaging the cable between the housing and the cable contacting member.

Telephone cables have a limited degree of diametric flexibility, and the pressure applied by clamping the cable between the housing and element 48 will tend to conform the cable cross-section to the resultant shape of opening 43. The sliding door will retain its clamping position against the cable due to the engagement between teeth 45 and 49, although with sufficient force the door may be opened if required. A wide variety of cable sizes may be accommodated by the sliding door arrangement since the size of the cable opening is thereby caused to change in accordance with the cable size, while the cable shape is caused to change in accordance with the opening contour.

In some circumstances, extremely thin cable may be used and a snug fit in opening 43 may be impossible to achieve because lips 51 abut against the arc of the U-shaped housing before the cable is firmly clamped. In this instance, the lips 51 may be physically removed from element 48, for example by a wire cutter. The narrower remaining portion 50 is then capable of approaching the arc of the U-shaped housing more closely and can firmly clamp even the narrowest type of cable known to be employed with the illustrated connector.

Figure 8:
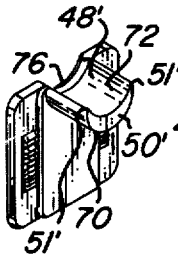
FIG. 8 is a view similar to FIG. 6, showing another embodiment of the sliding door.

With reference to FIG. 8, a modified version of the cable contacting member is designated 48' and is identical to member 48 in function and connection to planar panel 47. However, cable contacting member 48' differs in its general configuration as viewed along an axis normal to panel 47. The shape may be discribed as a crescent wherein the lower edge 70 has an arc of equal or smaller radius than the arc of upper edge 72. The lower edge is preferably at least a semicircle of 180 degrees and the upper edge is preferably an arc of 180 degrees or less, for example 150 to 170 degrees. The upper edge configuration is adapted to contact a cable and therefore is desired to be a smooth curve, while the lower edge may have greater variation. In the case where the lower edge is of smaller radius than the upper edge, the crescent may be formed by the intersection of the two curves; and in the case where the lower edge is of equal radius with the upper edge, the lower edge may continue its arc with parallel sides forming a U shape to meet the upper edge. Regardless of how the crescent shape of the cable contacting member is formed, the crescent maintains the general characteristics attributed to member 48 in that it is arcuate or troughed when viewed along an axis normal to the panel 47, and its central area 50' is thicker than the lateral edges 51' near the intersection of the upper and lower edges. The edges 51' may also be referred to as lips, and when a narrow cable is to be clamped with member 48', the lips or laterals edges 51' may be snipped off with the result that the cable contacting member is able to more closely approach the base of the U-shaped housing to produce a snug seal, as previously described.

An additional seal may be employed in the form of an arcuate rib 75 protruding into the cable opening 43 from the base of the U shape. The preferred location for rib 75 is on inner wall 42, immediately adjacent to the outwardly facing side thereof. In this way, the rib 75 will not interfere with the sliding action of panel 47 but will be essentially adjacent to panel gap 55. A similar rib 76 may be located on cable contacting member 48 or 48' at the rearward or inside edge thereof, which is the edge closest to panel 47. Ribs 75 and 76 will be understood to cooperate in creating a sealing ring around a clamped cable. The ring will have a slight offset or discontinuity due to the fact that ribs 75 and 76 operate in slightly different transverse planes relative to the cable axis, but because the ribs are in planes with sliding abutment, the seal is quite efficient. Each rib may have an arc of 180 degrees, and rib 75 may fully conform to the U shape of opening 43. The preferred dimension for the ribs is a height or protrusion of 0.020 inch into opening 43, and a width of approximately the same dimension.

The connector cover will then be understood to be a water and dirt resistant capsule surrounding the connector 12 and having a firm seal to the cables 15 and 16. The cover can lie loosely on the floor in those situations where it is not possible to mount the cover elsewhere. Alternatively, provision is made for attaching one portion of the cover to the wall or other raised object. One of the two body portions may have internally raised annular flanges 60 at either end thereof, and the compositional material of the cover may be of reduced thickness at the center of the flange. A screw 61, FIG. 5, may be inserted through the center of each flange from the inside of the body portion and used to attach the one portion, for example portion 19, to a wall or the like, as illustrated in FIG. 1. Thereafter, the unattached body portion 18 is snapped into engagement with portion 19 to carry the connector 12 in an off-the-floor location.

For the described purpose of protecting telephone connectors, the cover may have a thickness inclusive of walls 20 and 20' of one inch, length between end walls 21 and 22 of 5.25 inches, and height between top and bottom walls 23 and 24 of 2.5 inches. The cable openings with the sliding door in place may have a maximum dimension of about 0.612 inch and a width between the sides of the U shape of about 0.313 inch. The arc of the U shape and the arc of cable contacting member 48 are both approximately 0.0313 inch diameter. Each lip 51 may be approximately one-sixth to one-third of the total arc of the member 48. Each cable housing 40 may extend for about one-fourth inch from the cover end wall, and the member 48 will therefore extend about 0.340 inch from panel 47 if the typical wall thickness is 0.90 inch so that the member 48 will terminate outwardly on an even plane with the terminal edge of the housing. In the telephone cable art, it is common for the smallest cables to contain as few as four wires, while the largest cables with which the connector cover is adapted for use presently contain twenty-five pairs of wires. Some cable arrangements presently combine seventy-five pairs of wires in a single cable, which branches into three smaller cables of twenty-five pairs of wire in each, and each of the branches terminates in a connector half 13 or 14. This type of exceptionally large cable can be accommodated by using a separate cover 10 of suitable size over the connector of each cable branch, or a connector cover similar to that here described could be produced with sufficient size to contain three connectors, and the cable may be clamped in a single, larger cable opening 43 sized to accommodate such a cable size.

Although the invention has been described with respect to a specific embodiment, a great number of changes could be made without departing from the spirit of the invention. The cover has been disclosed to employ independent mating halves 18 and 19, but other body means could include such halves hinged together at one side and snapped together at the opposite side. The cable openings 43 could vary in position and number for other applications. The snap-together union between the body halves could take forms other than that described, and, in particular, could be replaced by flat abutting edges or single tongue and groove construction. The union means may include screws or like fasteners inserted through one half of the cover body and anchored in the opposing half to aid in holding the halves together. Finally, the angled teeth 45 and 49, which constitute friction means for holding the sliding door in a fixed position, might be replaced by other means for holding the sliding door in a fixed position. The purpose of the angled teeth as illustrated is to allow the door to be closed with relative ease, as the tooth sides striking each other during closure are a more gentle slope than the sides striking each other during door opening. One or both sets of teeth could be replaced by various types of groove and ridge construction or bosses. The friction means of the door should mate with that of the cover end wall, and the exact surface of the door and cover walls carrying the friction means is not critical as long as the friction means operatively engage and are therefore on facing surfaces.

I claim:

1. A cable connector cover, comprising:

(a) a body means for containing a cable connector therein and having a cable passage opening formed therein, said opening having an arcuate side on at least one edge thereof, the body means comprising separably joined together first and second body portions having a joining line dividing the cable passage opening and arcuate side thereof;

(b) sliding door means associated with said cable passage opening and having an arcuate edge substantially opposed to the arcuate side of the opening;

(c) guide means for directing the sliding door means in a path toward the arcuate edge of the opening to cover a substantial portion of the opening; and (d) directionally biased friction means for retaining the door in a given position along said path toward the arcuate edge of the opening while permitting the door to be moved normally thereto substantially in the plane of the opening when said first and second body portions are separated at said joining line.

2. The cable connector cover of claim 1, further comprising separable union means between said first and second body portions along said joining line for allowing the body to be opened for insertion of a cable and connector, said union means comprising a double tongue structure on said first body portion wherein a first tongue extends directly toward the second body portion and a second tongue extends normally to said first tongue; and a double groove structure on said second body portion wherein a first groove extends directly into said second body portion for receiving said first tongue, and a second groove extends normally to said first groove for receiving said second tongue.

3. The cable connector cover of claim 1, wherein:

(a) said body means further comprises a U-shaped housing associated with said cable opening and surrounding a portion thereof, the arcuate side of the opening being adjacent to the arcuate base of the U-shaped housing; and (b) said sliding door means comprises a plate having said arcuate edge at one side thereof and a cable contacting member extending normally to the plate from said arcuate edge thereof, the cable contacting member having suitable width to fit between the sides of the U-shaped housing, and being slidable with the plate toward the base of said U-shaped housing for clamping a cable.

4. The cable connector cover of claim 3, wherein:

(a) said guide means comprises a double walled portion of said body means adjacent to said cable opening and having a gap between the walls for receiving said plate in sliding relationship, the cable contacting member extending through said cable opening and between the sides of the U-shaped housing; and (b) said friction means comprises a first tooth on said plate and a second tooth on a facing surface of said double walled portion of the body means positioned to contact the first tooth and restrain it against pressure thereover.

5. The cable connector cover of claim 4, further comprising:

(a) first rib means protruding into said cable passage opening from at least one wall of said double wall portion in a first plane adjacent to said gap; and (b) second rib means protruding into said cable passage opening from said cable contacting member in a second plane parallel to the plane of said first rib means.

6. The cable connector cover of claim 3, wherein said cable contacting member comprises a concavely troughed surface facing the arcuate base of said U-shaped housing.

7. The cable connector cover of claim 1, further comprising:

(a) first rib means on said body means protruding into the cable passage opening from said arcuate side thereof; and (b) second rib means on said sliding door means protruding into the cable passage opening from said arcuate edge thereof.

8. A cable connector cover, comprising:

(a) body means for containing a cable connector therein, and having a cable passage opening forming therein, said opening having an arcuate side on at least one edge thereof, said body means comprising first and second body portions having separable union means therebetween for allowing the body to be opened for insertion of a cable and a connector; said union means comprising a double tongue structure on said first body portion wherein a first tongue extends directly toward the second body portion and a second tongue extends normally to said first tongue; and a double groove structure on said second body portion wherein a first groove extends directly into said second body portion for receiving said first tongue, and a second groove extends normally to said first groove for receiving said second tongue;

(b) sliding door means associated with said cable opening and having an arcuate edge substantially opposed to the arcuate side of said opening;

(c) guide means for directing said door in a path over a substantial portion of said opening; and (d) friction means for retaining the door in a given position.

* * * * *